US007044139B2

(12) United States Patent
Tong

(10) Patent No.: US 7,044,139 B2
(45) Date of Patent: May 16, 2006

(54) HAIR CURLING IRON AND SHAPING TOOL

(75) Inventor: Kwok Kuen Tong, Hong Kong (CN)

(73) Assignee: Hometek International Ltd., Hong Kong (CN)

( * ) Notice: Subject to any disclaimer, the term of this patent is extended or adjusted under 35 U.S.C. 154(b) by 368 days.

(21) Appl. No.: 10/632,252

(22) Filed: Aug. 1, 2003

(65) Prior Publication Data

US 2005/0022836 A1 Feb. 3, 2005

(51) Int. Cl.
*A45D 2/40* (2006.01)
*A45D 1/04* (2006.01)

(52) U.S. Cl. ..... 132/225; 132/232

(58) Field of Classification Search ..... 132/226, 132/227, 229, 232, 225; 219/222, 225
See application file for complete search history.

(56) References Cited

U.S. PATENT DOCUMENTS

| | | | |
|---|---|---|---|
| 1,014,952 | A | 1/1912 | Cox |
| 1,909,894 | A | 5/1933 | Protzky |
| 3,516,420 | A | 6/1970 | Porter |
| 4,479,047 | A | 10/1984 | Khaja et al. |
| 4,739,151 | A | 4/1988 | Smal |
| 5,223,694 | A | 6/1993 | Tsuji et al. |
| 5,957,140 | A | 9/1999 | McGee |
| 6,920,886 | B1 * | 7/2005 | McCambridge et al. .... 132/232 |
| 2003/0071027 | A1 | 4/2003 | Lo |

* cited by examiner

*Primary Examiner*—Kevin Shaver
*Assistant Examiner*—Stephanie L. Willatt
(74) *Attorney, Agent, or Firm*—Richard M. Goldberg

(57) ABSTRACT

A hair curling iron/straightener includes a handle; a first elongated member connected with the handle and having a first flat straightening surface; a heating element for heating the first elongated member; a second elongated member pivotally connected relative to the first elongated member and including a second flat straightening surface for mating with the first flat straightening surface to straighten hair placed therebetween, and a curved surface; a second heating element for heating the second elongated member; a curved elongated member pivotally connected relative to the second elongated member for engaging with the curved surface thereof; a first lever for actuating the curved elongated member to pivot the curved elongated member away from the second elongated member; and a second lever for actuating the second elongated member to pivot the second elongated member and the curved elongated member together away from the first elongated member.

15 Claims, 10 Drawing Sheets

HAIR CURLING IRON AND SHAPING TOOL

BACKGROUND OF THE INVENTION

The present invention relates generally to hair curling irons and hair shaping tools, and more particularly, is directed to a combination hair curling iron and shaping tool.

It is known to provide a hair styling iron for straightening and curling hair.

For example, U.S. Pat. No. 5,233,694 to Tsuji et al discloses a hair styling iron for straightening and curling hair that includes a lower half cylindrical section extending fixedly from the handle and an upper half cylindrical section pivotally mounted relative to the lower half cylindrical section such that the flat surfaces can engage to straighten hair. There is also an elongated curved plate that is pivotally mounted relative to the upper half cylindrical section. The curved plate has a transverse curvature to match the half cylindrical curvature of the upper surface of the upper half cylindrical section such that the curved surfaces engage to curl hair. With this patent, the lower half cylindrical section, upper half cylindrical section and curved plate are normally moved away from each other in an open position by springs. When it is desired to straighten hair, the curved plate is pushed down onto the upper half cylindrical section and locked. Then, hair is placed between the flat surfaces of the upper and lower half cylindrical sections, and the upper half cylindrical section is pushed down against the lower half cylindrical section, and can be locked therewith, or merely held in place. When released, the spring will move the upper and lower half cylindrical sections apart. Of course, the person is pushing down on the non-heated portions of the upper and lower half cylindrical sections, and on the curved plate. When it is desired to curl hair, the upper and lower half cylindrical sections are locked together, and the curved plate is moved down onto the upper curved surface of upper half cylindrical plate, as desired. However, this structure and operation is rather complicated and cumbersome to use, since it requires different locking mechanisms at different positions prior to use.

U.S. Patent Publication No. 2003/0071027 to Lo discloses an arrangement similar to U.S. Pat. No. 5,233,694 to Tsuji et al. Thus, there is a lower semi-barrel, an upper semi-barrel and an upper curved plate that engages the upper curved surface of the upper semi-barrel. There is a lever connected with the upper curved plate. There is also a slide switch that can connect or disconnect the curved plate from the upper semi-barrel. When the upper semi-barrel and curved plate are connected, actuation of the lever pivots the upper curved plate and the upper semi-barrel connected therewith, so that the device is used as a straightener between the flat surfaces of the upper semi-barrel and the lower semi-barrel. When disconnected, the upper curved plate alone moves upwardly relative to the upper semi-barrel so that the device is used as a curling iron. Again, this patent requires a separate locking mechanism prior to use, which makes it cumbersome to use.

U.S. Pat. No. 4,739,151 to Smal discloses a straightening and curling iron that provides lower and upper jaws. The upper surface of the lower jaw is flat and the lower surface of the upper jaw has curved undulations. There is an intermediate jaw between the lower and upper jaws, with the upper surface of the intermediate jaw having mating undulations and the lower surface being flat. Therefore, the hair can be straightened between the intermediate jaw and the lower jaw, and can be curled between the intermediate jaw and the upper jaw.

U.S. Pat. No. 3,516,420 to Porter merely discloses a combination hair curling and straightening iron. However, this patent does not provide two flat surfaces for straightening hair.

OBJECTS AND SUMMARY OF THE INVENTION

Accordingly, it is an object of the present invention to provide a hair curling iron and shaping tool that overcomes problems with the aforementioned prior art.

It is another object of the present invention to provide a hair curling iron and shaping tool that can selectively curl hair or otherwise shape hair in a different manner.

It is still another object of the present invention to provide a hair curling iron and shaping tool that has flat, wave-like or zig-zag sections for straightening, waving or crimping hair and curved sections for curling hair.

It is yet another object of the present invention to provide a hair curling iron and shaping tool having a dual lever arrangement which selectively opens the curved sections for curling hair or the shaping sections for shaping hair.

It is a further object of the present invention to provide a hair curling iron and shaping tool in which the two levers of the dual lever arrangement interact with each other for controlling the operation of the hair curling iron and shaping tool.

It is a still further object of the present invention to provide a hair curling iron and shaping tool that is easy and economical to use and manufacture.

In accordance with an aspect of the present invention, a hair curling iron and shaping tool includes a handle; a first elongated member connected with the handle and having a first surface and a first heating element for heating the first elongated member. A second elongated member is pivotally connected relative to the first elongated member, the second elongated member including a second surface for mating with the first surface in order to shape hair placed therebetween in a predetermined manner defined by the first and second surfaces, said second surface having a profile complementary to the profile of the first surface, and a curved surface, and a second heating element is provided for heating the second elongated member. A curved elongated member is pivotally connected relative to the second elongated member for engaging with the curved surface of the second elongated member. Further, a first lever is provided for actuating the curved elongated member to pivot the curved elongated member away from the second elongated member, and a second lever is provided for actuating the second elongated member to pivot the second elongated member and the curved elongated member together away from the first elongated member.

Preferably, the second lever is positioned on top of the first lever. Also, the first lever is fixedly connected with the curved elongated member and the second lever is fixedly connected with the second elongated member.

Preferably, the first and second levers are pivotally mounted relative to the housing along a common axis. In this regard, the first and second levers each have opposite downwardly extending ears, each ear having an opening therein, and all of the openings of the ears being in axial alignment for receiving a pivot pin arrangement to pivotally fix the first and second levers relative to the housing.

The second lever includes an opening therein, and the first lever extends through the opening to a position below the second lever. The first lever and second lever also each have a free end with a head thereon for actuation by a user, and there is provided an arrangement for selectively connecting and disconnecting the heads together. The arrangement includes a recess in each head, the recesses being in alignment when the first and second levers are in a neutral position, and a button is slidable in one of the recesses and adapted to slide partially into the other recess for connecting the heads together.

A spring arrangement is fixed relative to the handle for normally biasing the first and second levers away from the handle such that the curved elongated member is normally seated on the curved surface of the second elongated member and the second surface of the second elongated member is normally seated on the first surface of the first elongated member.

Preferably, the first and second elongated members each have a generally semi-cylindrical shape, and the curved elongated member includes an elongated plate having a transverse curvature.

In one embodiment, the first and second surfaces are each flat for straightening hair placed therebetween. In another embodiment, the first and second surfaces each have a wave-like profile for waving hair placed therebetween.

In a further embodiment, the first and second surfaces each have a zig-zag profile for crimping hair placed therebetween.

The above and other objects, features and advantages of the invention will become readily apparent from the following detailed description thereof which is to be read in connection with the accompanying drawings.

DETAILED DESCRIPTION

Figure 2:
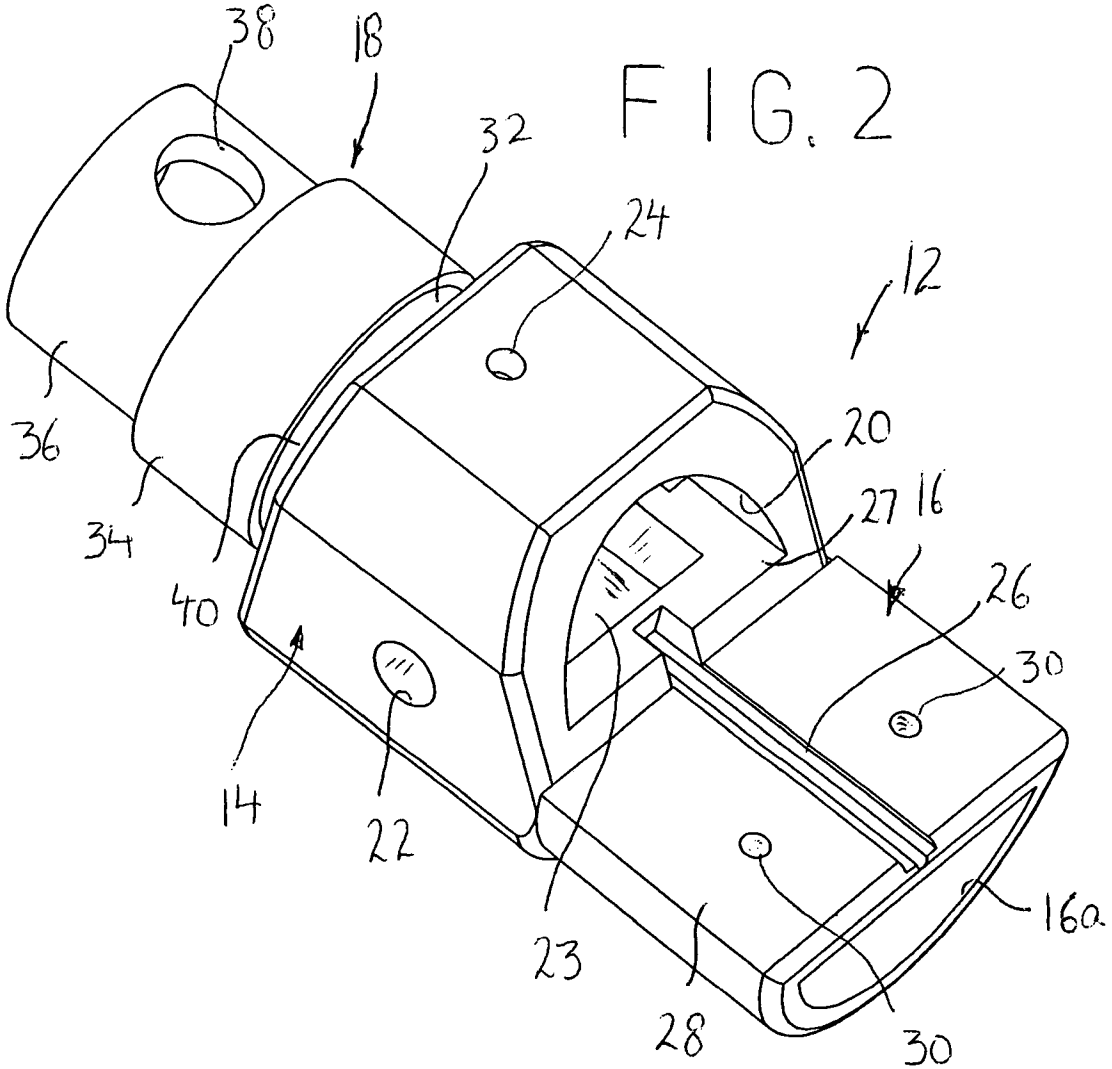
FIG. 2 is a perspective view of the central hub of the hair curling iron/straightener.

Referring to the drawings in detail, a hair curling iron/straightener 10 according to a first embodiment of the present invention includes a central hub 12 made of a suitable hard plastic material. As shown best in FIG. 2, hub 12 includes a central section 14 of a generally annular shape, a hollow heater securing end section 16 of a generally tubular shape extending outwardly from the front end of central section 14 and a hollow handle securing end section 18 of a generally semi-cylindrical shape extending outwardly from the rear end of central section 14.

Central section 14 has an upper hollow tunnel 20 extending therethrough of a generally semi-cylindrical shape which is in open communication with the hollow interior of handle securing end section 18 in order to permit a first electrical wire 21 to pass therethrough and out through the front opening of upper hollow tunnel 20, and a lower hollow section 23 extending therethrough which is in open communication with the hollow interiors of heater securing end section 16 and handle securing end section 18 in order to permit a second electrical wire 25 to pass therethrough and out through the open front end 16*a* of heater securing end section 16. Central section 14 further includes diametrically opposed openings 22 at opposite side walls thereof, the purpose for which will become apparent from the description which follows. A threaded opening 24 is provided in the upper surface of central section 14. In addition, a groove 26 is provided partially in a front wall 27 of central section 14 at the end which connects with heater securing end section 16. Groove 26 extends from front wall 27 lengthwise and centrally through the upper flat surface 28 of heater securing end section 16. Two threaded openings 30 are provided in upper flat surface 28 on opposite sides of groove 26.

Handle securing end section 18 includes a first hollow tubular section 32 of a first diameter connected with the rear end of central section 14, followed by a second hollow tubular section 34 of a second, greater diameter, and finally, followed by a third hollow tubular section 36 of a third diameter less than the second diameter. In this manner, an effectively annular recess 40 is formed along the outer annular surface of first hollow tubular section 32 between the rear end of central section 14 and second hollow tubular section 34. In addition, diametrically opposite openings 38 are formed at the upper and lower surfaces of third hollow tubular section 36.

Figure 1:
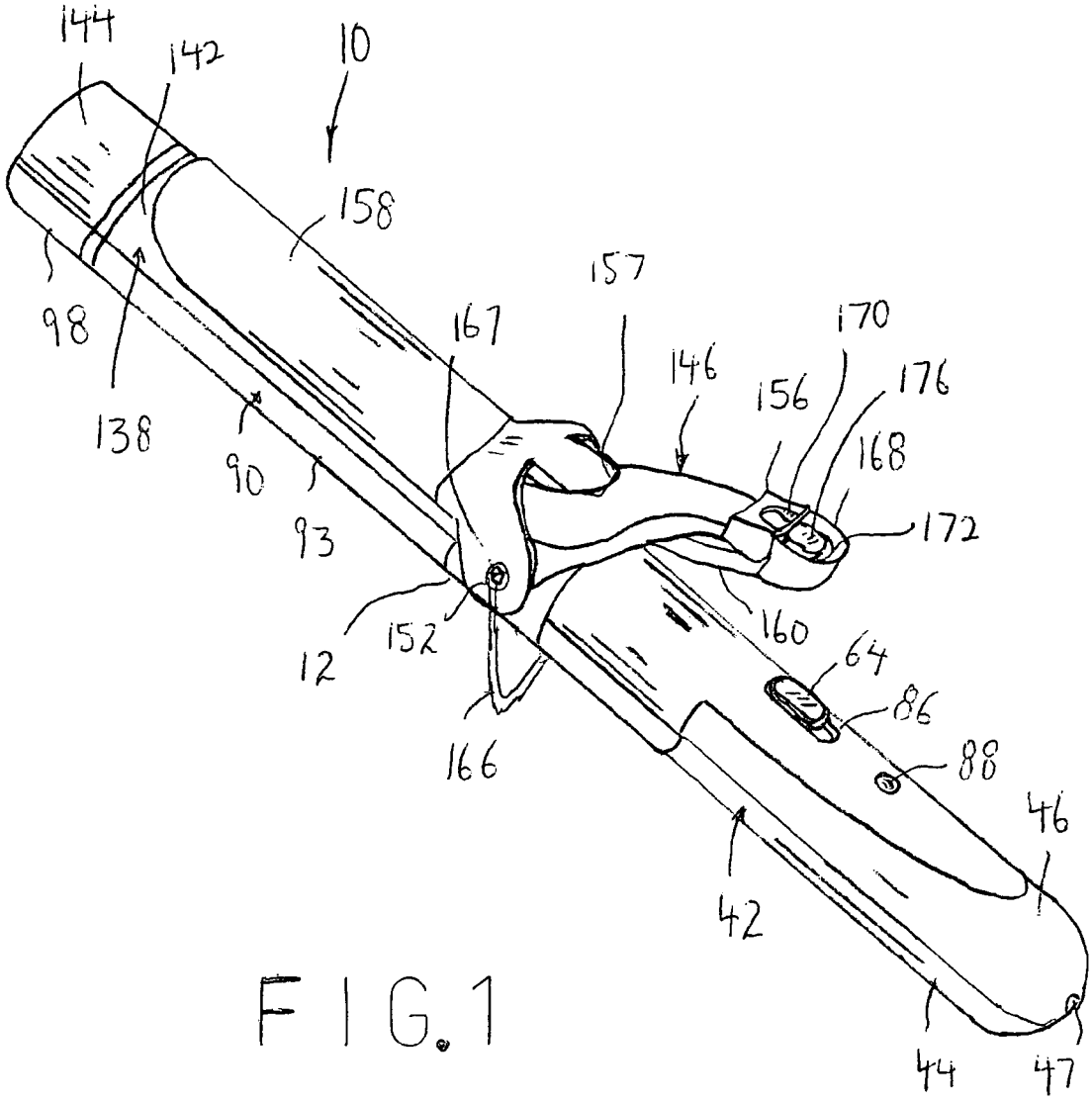
FIG. 1 is a perspective view of a hair curling iron/straightener according to a first embodiment of the present invention.
Figure 4:
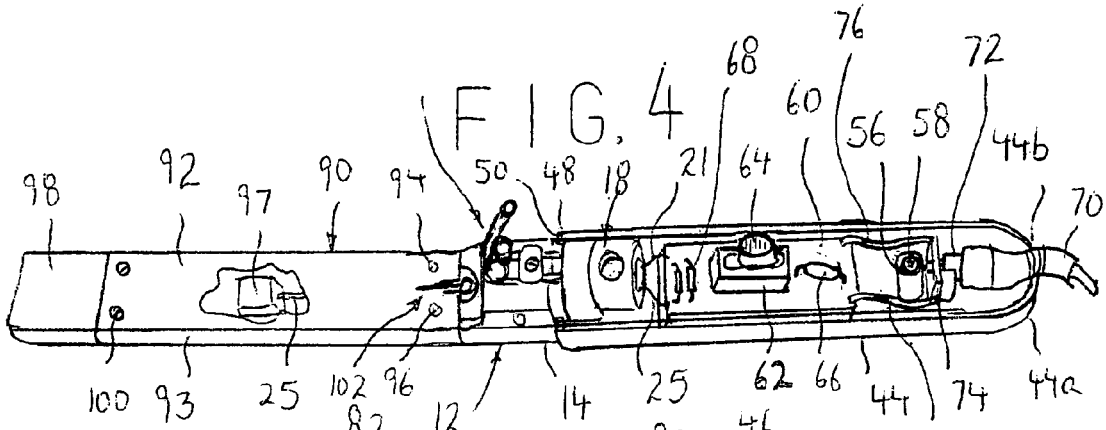
FIG. 4 is a perspective view of lower half shell of the handle connected with the central hub and lower semi-cylindrical straightening barrel.
Figure 5:
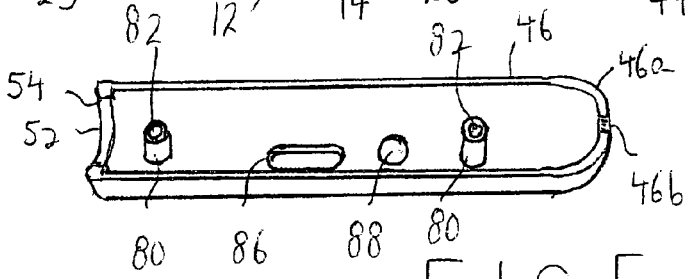
FIG. 5 is a perspective view of the upper half shell of the handle.

As shown best in FIGS. 4 and 5, hair curling iron/straightener includes a tubular handle 42 formed by a lower half shell 44 and a mating upper half shell 46, each being of a generally thin-walled semi-cylindrical shape which is rounded at the rear ends 44*a* and 46*a* thereof for closure. Semi-circular openings 44*b* and 46*b* are provided at rear ends 44*a* and 46*a*, respectively, for forming a small opening 47 (FIG. 1) at the rear end of hair curling iron/straightener 10.

Lower half shell 44 has a semi-circular open front end 48 with a slightly inturned lip 50 thereat for engaging in annular recess 40 to retain central hub 12 therein. In like manner, upper half shell 44 has a semi-circular open front end 52 with a slightly inturned lip 54 thereat for engaging in annular recess 40 to retain central hub 12 therein. In this manner, central hub 12 is captured by the front ends of upper and lower half shells 44 and 46.

Lower half shell 44 also includes two spaced apart posts 56 extending outwardly from the curved inner surface thereof, and the forwardmost post 56 (not shown) is engaged within the lower opening 38 in third hollow tubular section 36 for further retaining central hub 12 therein. Each post 56 has a through bore 58 extending therethrough and is open at the underside of lower half shell 44.

A printed circuit board 60 is mounted within lower half shell 44 between posts 56 and includes a three position switch 62 having a slidable button 64 thereon for movement to a low heat position, a high heat position and an OFF position. This determines the amount of electricity passed through wires 21 and 25 which are connected to the front end of printed circuit board 60. A light emitting diode (LED) 66 is also mounted on printed circuit board 60, rearwardly of switch 62, and various electronic components such as resistors 68 are mounted on printed circuit board 60.

An electrical supply cord 70 having a conventional two prong plug (not shown) at one end, extends through opening 47 and has a coaxial connector 72 at the opposite end which engages with an electrical connector board 74 mounted in lower half shell 44 and which has electrical connections that electrically connect with the respective terminals of coaxial connector 72. Electrical wires 76 and 78 electrically connect the electrical connections of electrical connector board 74 to printed circuit board 60. As a result, depending upon the position of slidable button 64, electrical current is selectively supplied to wires 21 and 25.

Upper half shell 46 also includes two spaced apart posts 80 extending outwardly from the curved inner surface thereof, and the forwardmost post 80 is engaged within the upper opening 38 in third hollow tubular section 36 for further retaining central hub 12 therein. Posts 80 have the same spacing as posts 58. Each post 80 has a threaded bore 82 extending therethrough and is open at the free end. Thus, when lower half shell 44 and upper half shell 46 are assembled together to form tubular handle 42, bolts (not shown) extend through posts 58 from the underside of lower half shell 44 and are threadedly received in posts 80.

Upper half shell 46 further includes an elongated opening 86 through which slidable button 64 extends for actuation by a user, and a transparent or translucent window 88 positioned immediately over LED 66. In this manner, when the two prong plug is inserted into a wall socket and slidable button 64 is moved to either the low heat position or the high heat position, LED 66 is illuminated and can be viewed through window 88 to warn the user.

A lower, hollow, semi-cylindrical metal straightening barrel 90 is open at opposite ends thereof, with the rear end thereof receiving heater securing end section 16 therein. Lower straightening barrel 90 includes a flat upper surface 92 with two spaced openings 94 which are in alignment with threaded openings 30 of heater securing end section 16, and also includes a curved lower surface 93. Bolts 96 extend through openings 94 and are threadedly received within threaded openings 30 for fixedly securing lower straightening barrel 90 to heater securing end section 16. As shown generically in FIG. 4, a heater element 97 which is conventional is provided in lower straightening barrel 90 and is electrically connected with wire 25 extending out through heater securing end section 16. In this manner, the metal walls of lower straightening barrel 90 are heated. A non-heat transferring plastic cap 98 is secured in the opposite free open end of lower straightening barrel 90 by bolts 100, which operate in the same manner as bolts 96.

Figure 3:
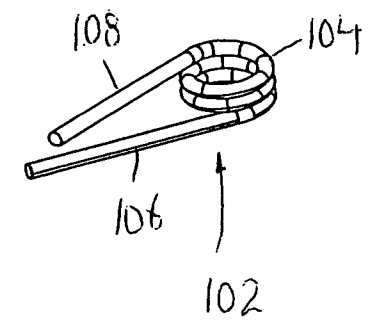
FIG. 3 is a perspective view of a first torsion spring used with the hub.

A torsion spring 102 having a coiled section 104 and two straight legs 106 and 108 extending in the same direction, is inserted in groove 26, with coiled section 104 extending within the portion of groove 26 provided in front wall 27 of central section 14. Torsion spring 102 is best shown in FIG. 3. One leg 106 is captured between the flat surfaces of heater securing end section 16 and lower straightening barrel 90 and extends in that portion of groove 26 in heater securing end section 16, and the other leg 108 rests on the upper flat surface of lower straightening barrel 90.

Figure 6:
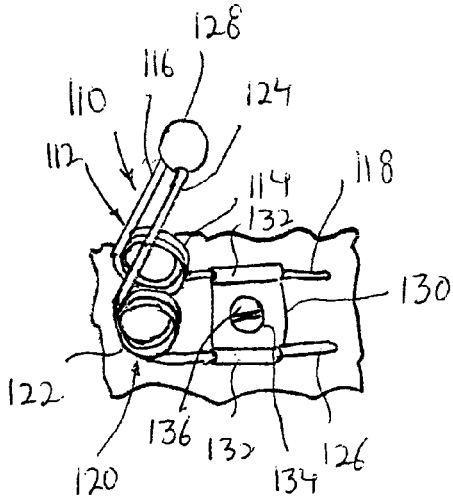
FIG. 6 is a perspective view of the second spring assembly mounted to the hub.
Figure 7:
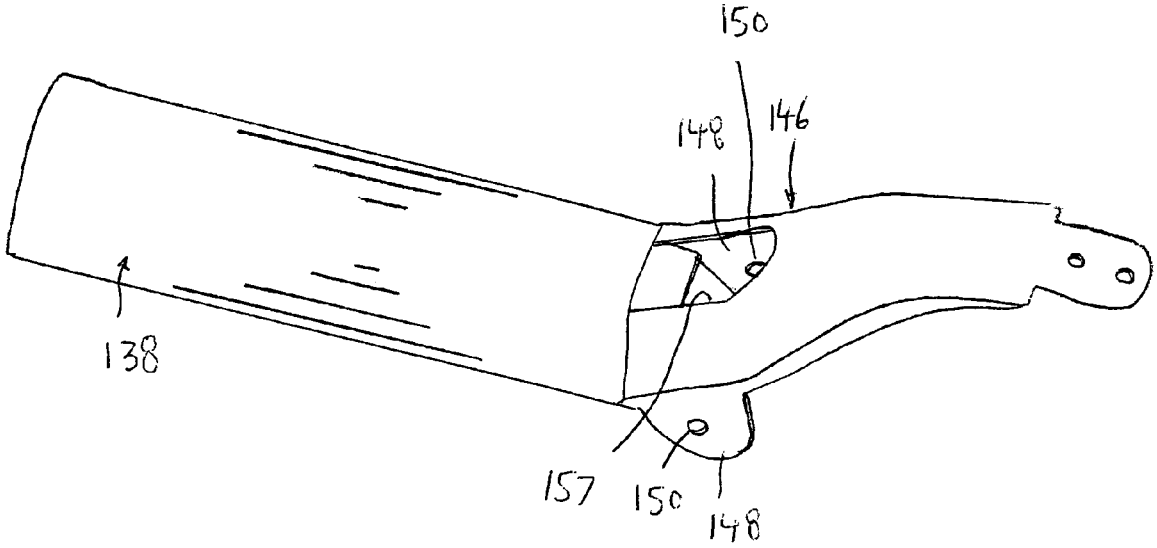
FIG. 7 is a perspective of the first lever fixed to the upper semi-cylindrical straightening barrel.
Figure 8:
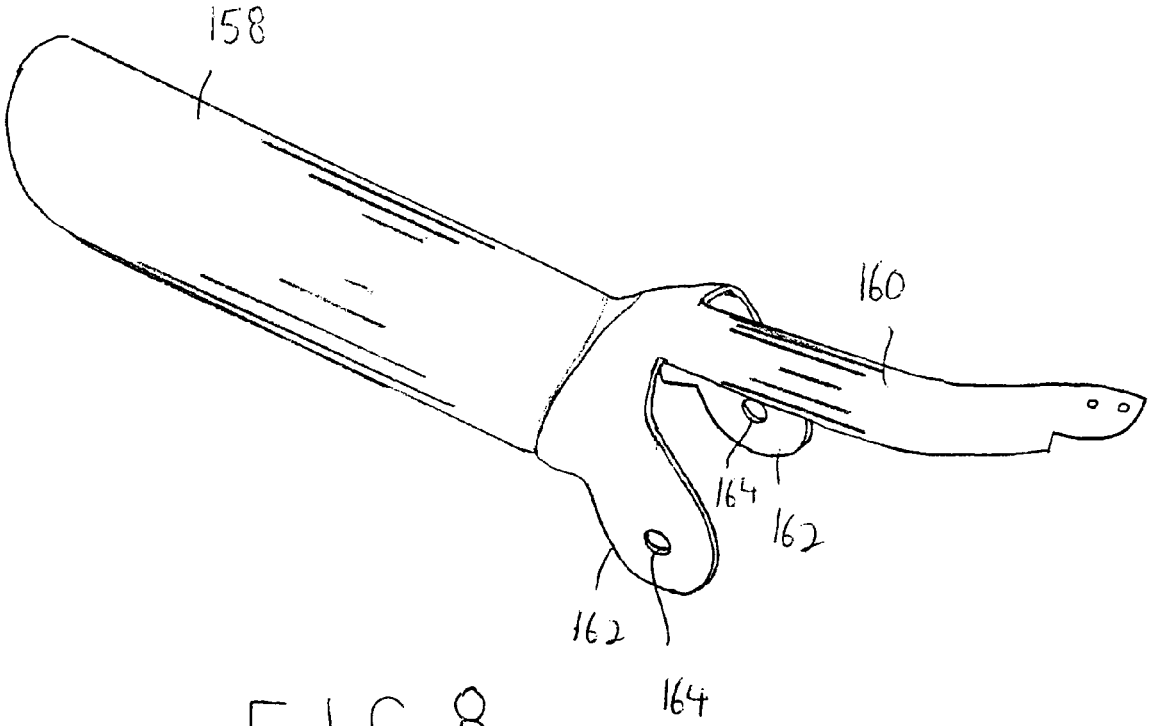
FIG. 8 is a perspective of the second lever fixed to curved elongated plate.

As shown best in FIG. 6, a spring assembly 110 includes a first torsion spring element 112 having a coiled section 114 and two legs 116 and 118 being offset by an acute angle, and a second torsion spring element 120 having a coiled section 122 and two legs 124 and 126 being offset by the same acute angle, with the free ends of legs 116 and 124 being connected together by a ball 128. The other legs 118 and 126 are clamped onto the upper surface of central section 14 of central hub 12. Specifically, a clamp plate 130 sits on the upper surface of central section 14 and includes two parallel arcuate raised sections 132 at opposite ends thereof for receiving and holding down legs 118 and 126. A hole 134 is provided in clamp plate 130 between sections 132, and a bolt 136 extends through hole 134 and is threadedly received in threaded opening 24 in order to fix clamp plate 130 to the upper surface of central section 14, and thereby hold down spring assembly 110 to central section 14. The use of two torsion spring elements 112 and 120 provides a greater spring force, and also prevents sidewards movement of spring assembly 110 upon the application of a downward force on legs 116 and 124.

An upper, hollow, semi-cylindrical metal straightening barrel 138 is open at opposite ends thereof, and includes a flat lower surface 140 for engaging with flat upper surface 92 in order to straighten hair placed therebetween, and also includes a curved upper surface 142. A heater element (not shown) which is conventional and which is the same as heater element 97, is provided in upper straightening barrel 138 and is electrically connected with wire 21 extending out through tunnel 20 of central hub 12. In this manner, the metal walls of upper straightening barrel 138 are heated. A non-heat transferring plastic cap 144 is secured in the free open end of upper straightening barrel 138 by any suitable means, such as welding, adhesive, bolts, friction fit, etc.

The rear end of upper straightening barrel 138 is connected to a first actuating lever 146 extending upwardly therefrom at an angle of about 45 degrees. Actuating lever 146 has downwardly extending ears 148 at opposite sides thereof at the position where actuating lever 146 is secured to upper straightening barrel 138, with ears 148 each having an opening 150 in alignment with each other. In this manner, a post 152 having a hollow head 154 can be positioned through each opening 150 into diametrically opposed openings 22 of central section 14 to pivotally secure upper straightening barrel 138 relative to lower straightening barrel 90. The free end of actuating lever 146 has a non-heat conducting plastic head 156 which a user can actuate without being burned from the heat transferred to actuating lever 146 from upper straightening barrel 138. Spring assembly 110 serves to bias the flat surfaces 92 and 140 of lower straightening barrel 90 and upper straightening barrel 138 into engagement with each other, and the force of spring assembly 110 can be overcome by a user pressing down on plastic head 156 in order to pivot actuating lever 146 and upper straightening barrel 138 about bolts 152 away from lower straightening barrel 90.

Further, an elongated, substantially rectangular opening 157 is provided in actuating lever 146 at a position between ears 148, the purpose for which will be made apparent from the description which follows.

In accordance with an important aspect of the present invention, a transversely curved, elongated plate 158 is provided for seating on curved upper surface 142 of upper straightening barrel 138 in order to curl hair placed therebetween. The rear end of curved plate 158 is connected to a second actuating lever 160 extending upwardly therefrom at an angle of about 45 degrees. Actuating lever 160 has downwardly extending ears 162 at opposite sides thereof at the position where actuating lever 160 is secured to curved plate 158, with each ear 162 having an opening 164 in alignment with each other. In the assembled condition, transversely curved, elongated plate 158 sits on the upper surface 142 of upper straightening barrel 138, and actuating lever 160 extends through rectangular opening 157 of actuating lever 146 and then beneath actuating lever 146. In this configuration, openings 150 and 164 are aligned, and are pivotally held together by posts 152 extending through openings 22 of central section 14.

In order to retain posts 152 in position, a generally U-shaped wire member 166 having inturned ends 167 is provided, with inturned ends 167 extending through hollow heads 154 of posts 152. Of course, other pivot pin arrangements could be provided. It will be appreciated that U-shaped wire member 166 also serves the purpose for hanging up hair curling iron/straightener 10 after use so that the heated portions will not burn a surface.

Figure 10:
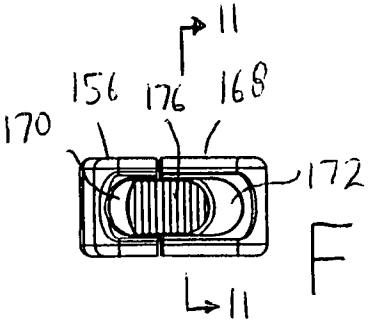
FIG. 10 is top plan view of the plastic heads and slidable button of the first and second levers of FIG. 9.
Figure 11:
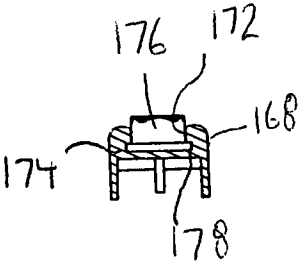
FIG. 11 is a cross-sectional view of one plastic head and the button of FIG. 10, taken along line 11—11 thereof.
Figure 9:
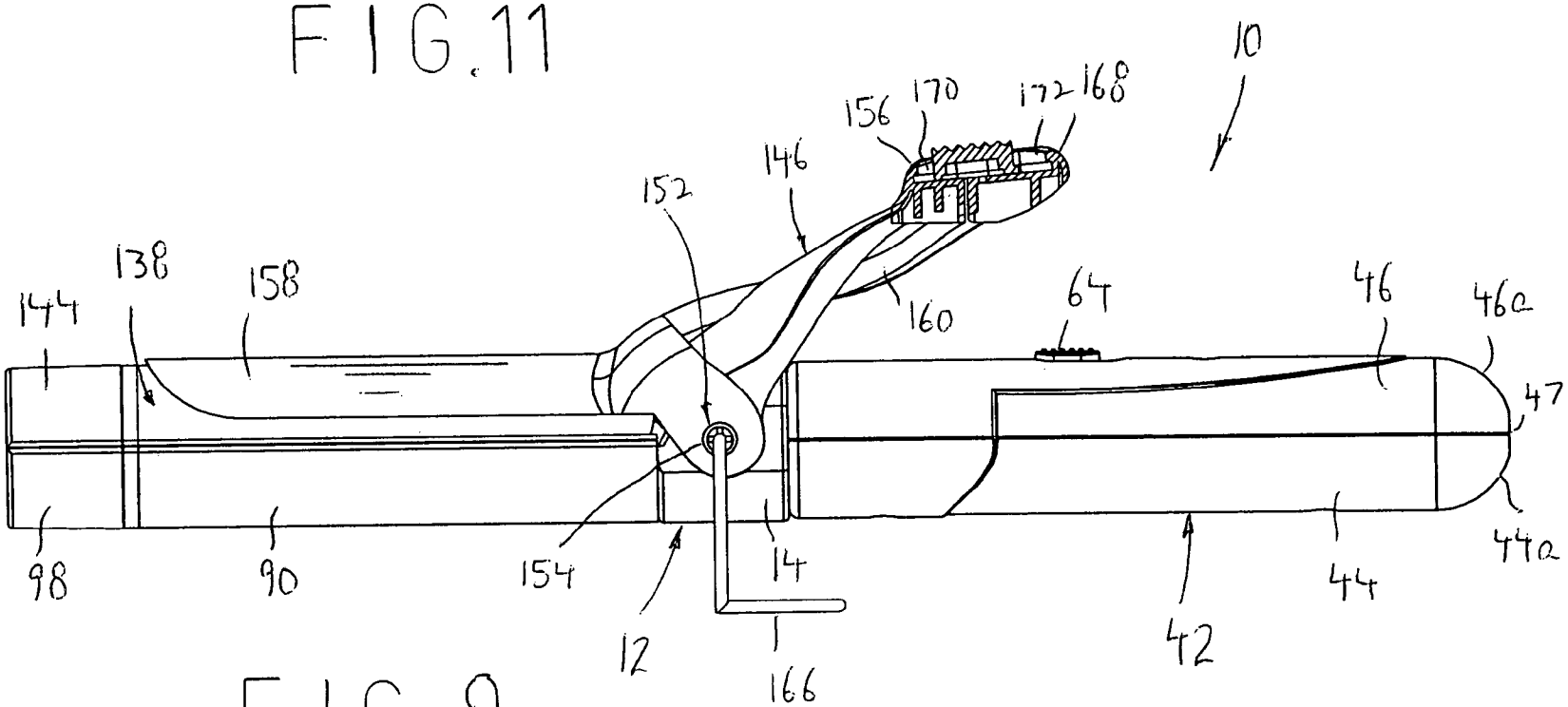
FIG. 9 is a side elevational view, partly in cross-section, of the hair curling iron/straightener, with the first and second levers in a neutral position.

As shown best in FIGS. 9–11, the free end of second actuating lever 160 that extends through rectangular opening 157 extends past the free end of first actuating lever 146, and includes a plastic head 168 which is positioned in line with and just rearwardly in juxtaposed relation to plastic head 156. Plastic heads 156 and 168 each include a recess 170 and 172, respectively, which open toward each other, each recess 170 and 172 having lower undercut regions 174 at opposite sides thereof. A slidable button 176 is inserted in recess 172, and has lower side tabs 178 that are retained in the undercut regions 174 thereof. Stops (not shown) are provided in recess 172 to prevent complete escape of button 176.

It will be appreciated that torsion spring 102 has a spring force which is less than that of spring assembly 110 in order to prevent free play of upper straightening barrel 138 relative to lower straightening barrel 90.

Figures 12, 13:
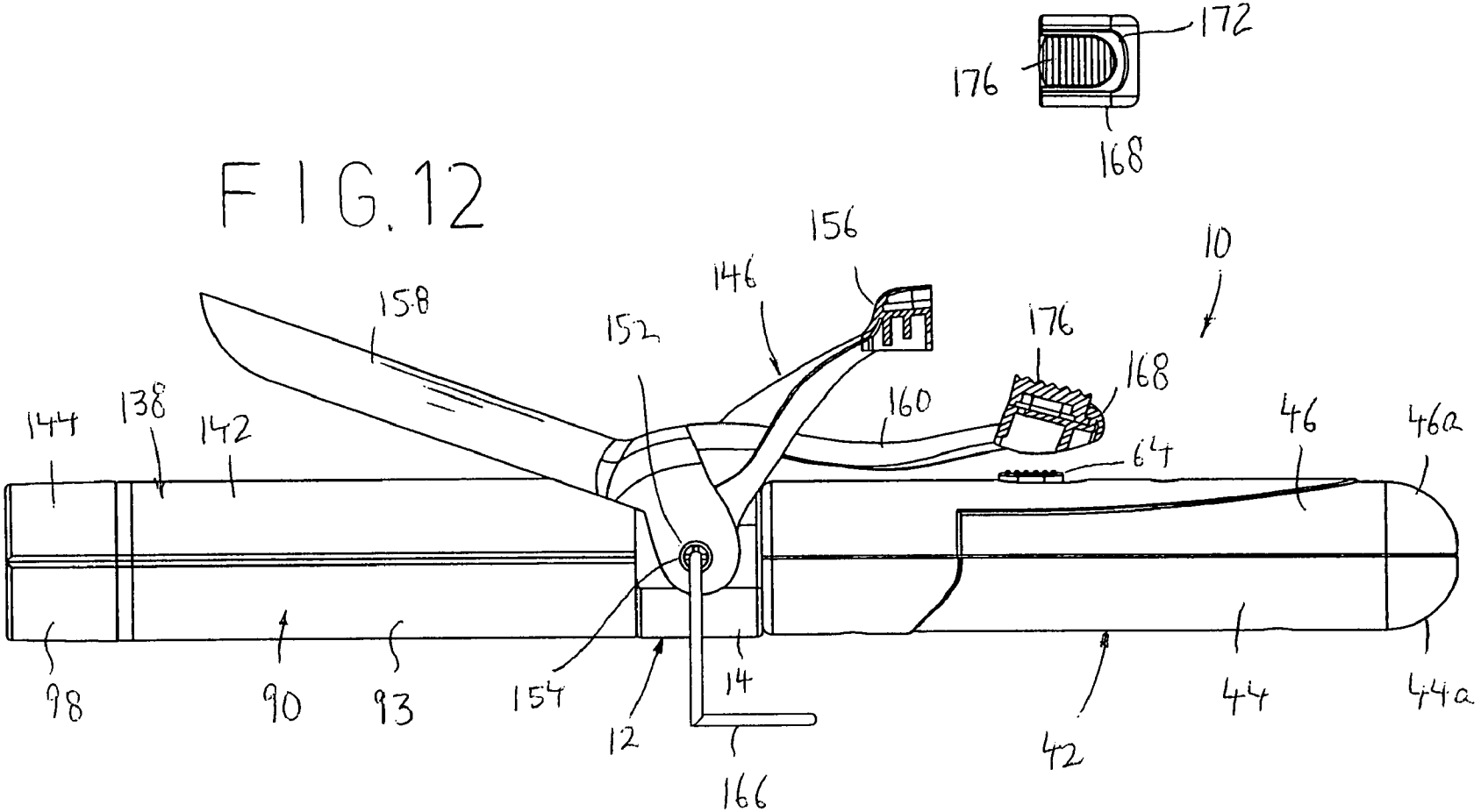
FIG. 12 is a side elevational view, partly in cross-section, of the hair curling iron/straightener, with the lever associated with the curved elongated plate actuated in order to raise the curved elongated plate away from the upper curved surface of the upper straightening barrel.
FIG. 13 is top plan view of the plastic head and slidable button of the actuated lever of FIG. 12.

In accordance with the present operation, when button 176 is slid to a position entirely within recess 172 of plastic head 168, as shown in FIGS. 12 and 13, depression of plastic head 168 will result only in the pivoting up of second actuating lever 160 and transversely curved, elongated plate 158 away from upper straightening barrel 138, so that hair can be placed therebetween. Then, when second actuating lever 160 is released, transversely curved, elongated plate 158 is biased by spring assembly 110 into contact with upper straightening barrel 138 in order to heat the hair therebetween by the heat from upper straightening barrel 138.

Figure 14:
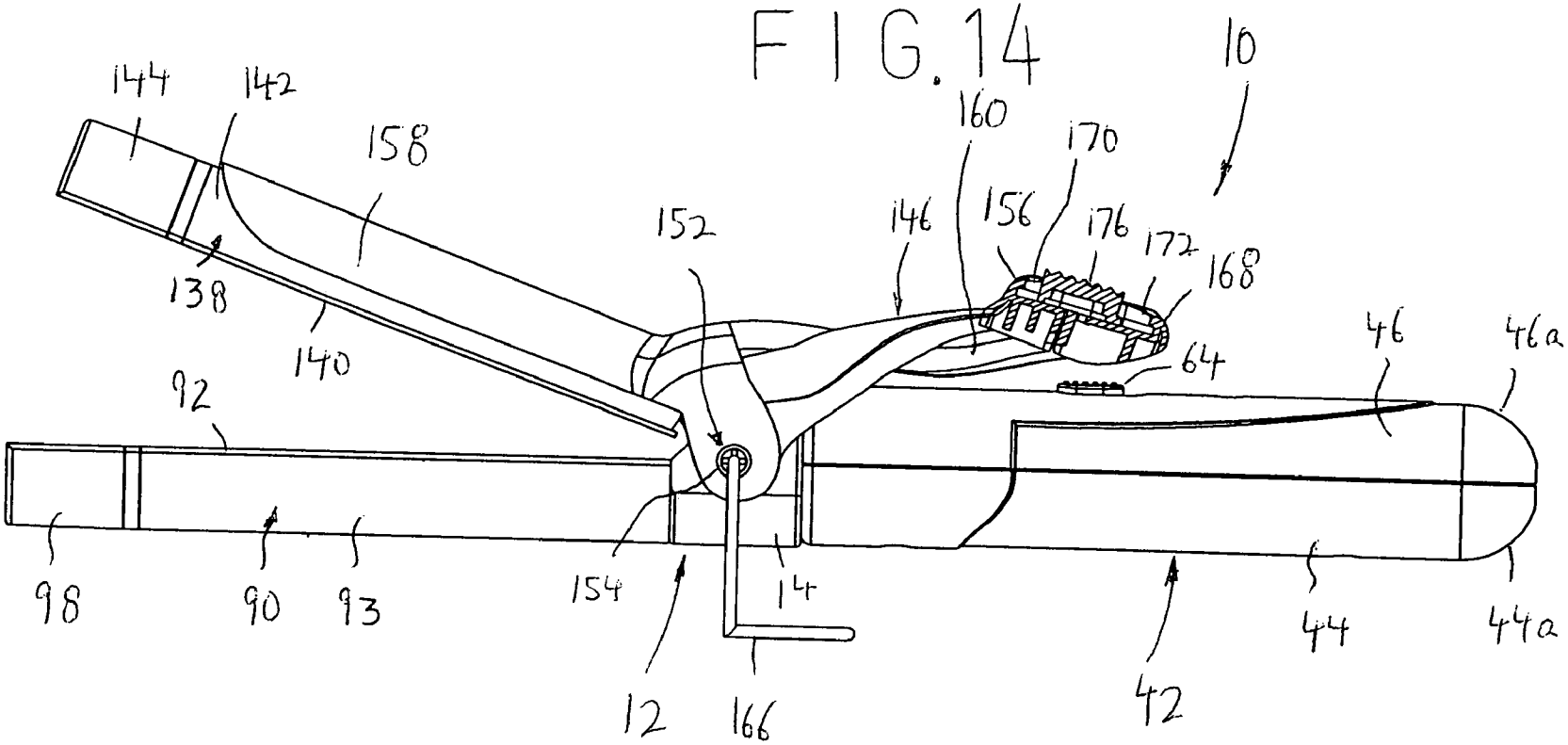
FIG. 14 is a side elevational view, partly in cross-section, of the hair curling iron/straightener, with the other lever associated with the upper straightening barrel actuated in order to raise the upper straightening barrel and curved elongated plate together away from the lower straightening barrel.

On the other hand, when button 176 is slid to a position partially within both recesses 170 and 172 of plastic heads 156 and 168, as shown in FIG. 14, levers 146 and 160 are tied together so that depression of plastic head 156 and/or plastic head 168 will result in the pivoting up of both first and second actuating levers 146 and 160. Thus, upper straightening barrel 138 is moved away from lower straightening barrel 90, so that hair can be placed therebetween. Then, when the respective actuating lever 146 and/or actuating lever 160 is released, upper straightening barrel 138 is biased by spring assembly 110 into contact with lower straightening barrel 90, in order to heat the hair therebetween by the heat from lower straightening barrel 90 and upper straightening barrel 138.

Figure 15:
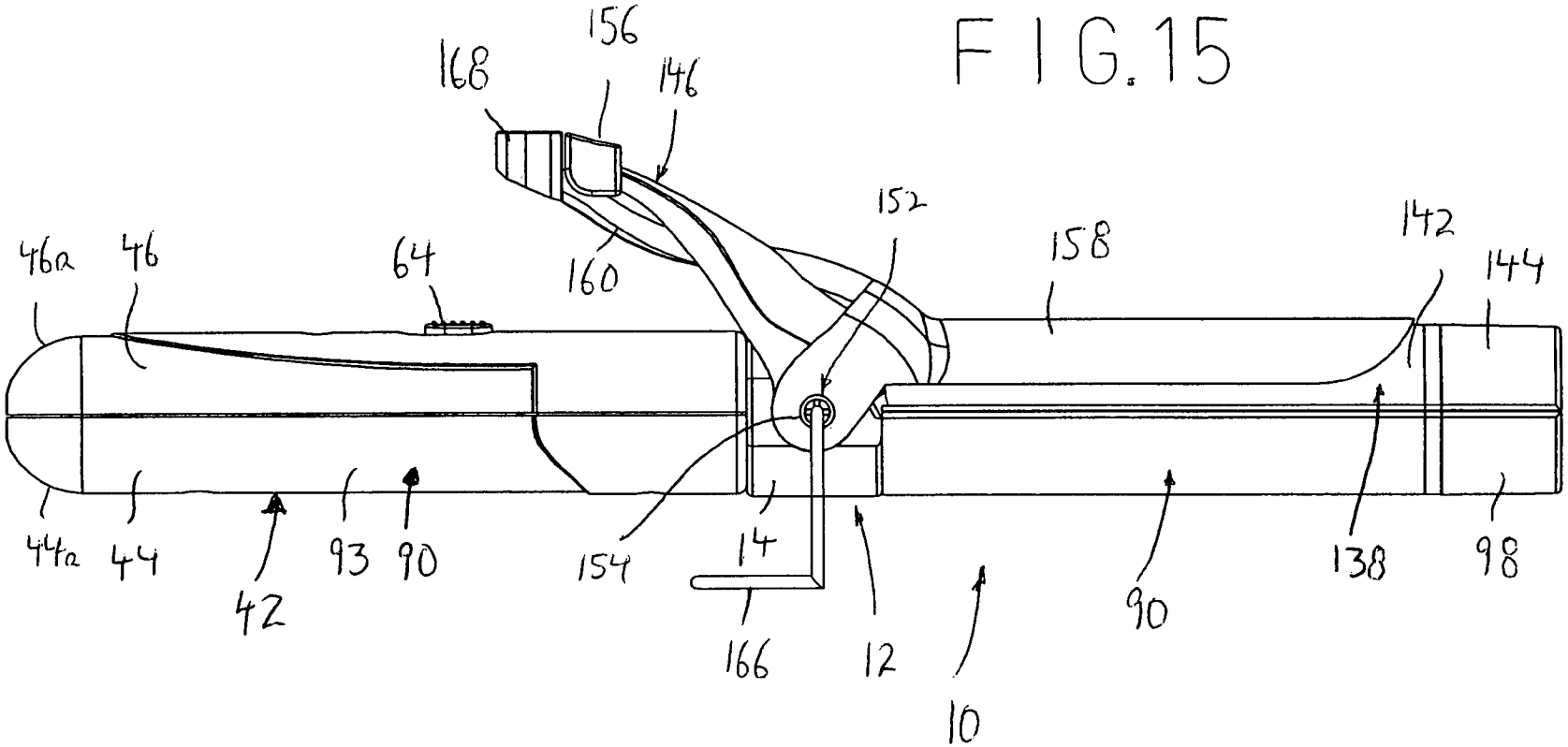
FIG. 15 is a side elevational view, partly in cross-section, of a modified hair curling iron/straightener according to another embodiment which eliminates the slidable button, and with the first and second levers in a neutral position.

Of course, it will be appreciated that button 176 can be eliminated, as shown in FIG. 15. In this case, actuation of plastic head 168 will only actuate second lever 160. However, actuation of plastic head 156 will actuate both levers 146 and 160, since the end of lever 146 is positioned on top of the end of lever 160.

It will therefore be appreciated that hair curling iron/straightener 10 can selectively curl hair or straighten hair by means of a dual lever arrangement comprised of actuating levers 146 and 160 which selectively open the curved sections for curling hair or the straight sections for straightening hair. Specifically, actuating levers 146 and 160 of the dual lever arrangement interact with each other for controlling the operation of hair curling iron/straightener 10.

Figure 17:
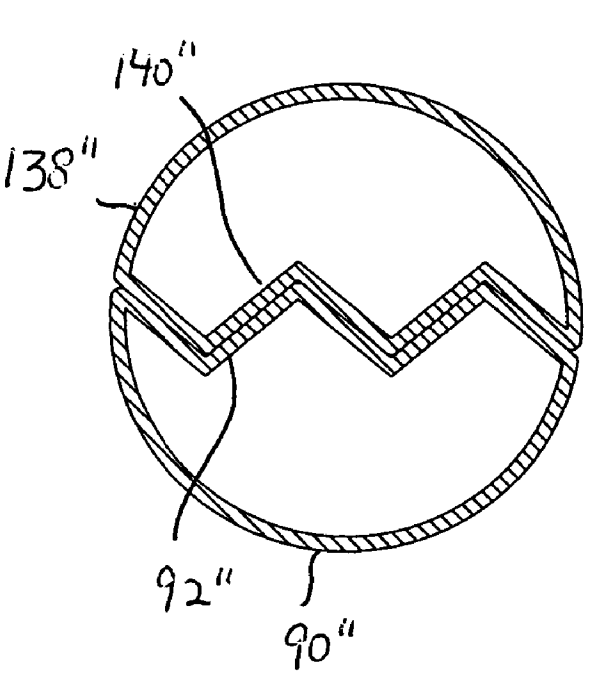
FIG. 17 is a cross-sectional view of a hair curling iron/crimper according to still another embodiment of the present invention.
Figure 16:
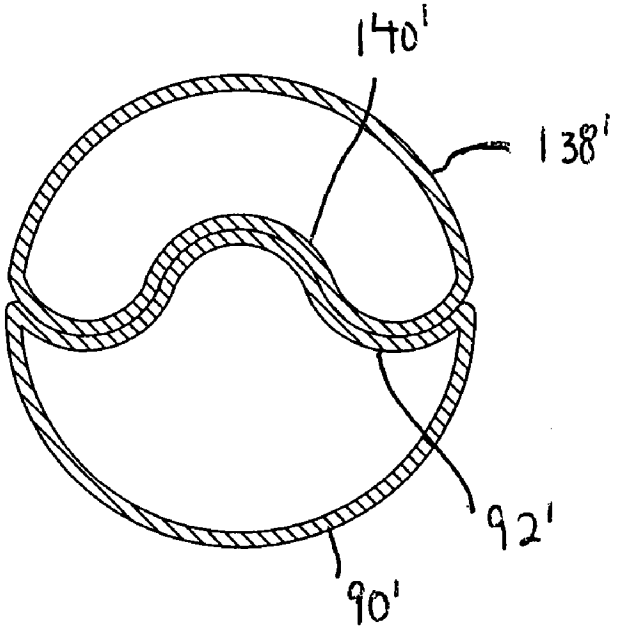
FIG. 16 is a cross-sectional view of a hair curling iron/waver according to another embodiment of the present invention.

It will be appreciated that modifications can be made to the present invention in accordance with the claims herein. For example, instead of a barrels 90 and 138 presenting mating flat surfaces 92 and 140, the mating surfaces can take other configurations. Specifically, in one modified embodiment of a hair curling iron/waver, the surfaces 92' and 140' of barrels 90' and 138' have wave-like profiles for waving hair placed therebetween. Alternatively, in another modified embodiment of a hair curling iron/crimper, the surfaces 92" and 140" of barrels 90" and 138" have zig-zag profiles for crimping hair placed therebetween. Of course, curved plate 158 of the first embodiment, which is not shown in FIGS. 16 and 17, would also be provided with these modified embodiments, and operates in the same manner as the embodiment of FIGS. 1–15. Of course, other profiles of the mating surfaces can be provided for otherwise shaping hair.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A hair curling iron and shaping tool comprising:

a handle;

a first elongated member connected with said handle and having a first surface with a first profile;

a first heating element for heating the first elongated member;

a second elongated member pivotally connected relative to said first elongated member, said second elongated member including:

a second surface for mating with said first surface in order to shape hair placed therebetween in a predetermined manner defined by the first and second surfaces, said second surface having a profile complementary to the profile of said first surface, and a curved surface;

a second heating element for heating the second elongated member;

a curved elongated member pivotally connected relative to said second elongated member for engaging with the curved surface of said second elongated member;

a first lever for actuating said curved elongated member to pivot said curved elongated member away from said second elongated member; and a second lever for actuating said second elongated member to pivot said second elongated member away from said first elongated member and for simultaneously engaging said first lever to pivot said curved elongated member together with said second elongated member away from said first elongated member.

2. A hair curling iron and shaping tool according to claim 1, wherein said first lever is fixedly connected with said curved elongated member and said second lever is fixedly connected with said second elongated member.

3. A hair curling iron and shaping tool according to claim 1, wherein said first lever and second lever each have a free end with a head thereon for actuation by a user.

4. A hair curling iron and shaping tool according to claim 1, further including a spring arrangement fixed relative to said handle for normally biasing said first and second levers away from said handle such that said curved elongated member is normally seated on the curved surface of the second elongated member and the second surface of the second elongated member is normally seated on the first surface of the first elongated member.

5. A hair curling iron and shaping tool according to claim 1, wherein the first and second elongated members each have a generally semi-cylindrical shape, and said curved elongated member includes an elongated plate having a transverse curvature.

6. A hair curling iron and shaping tool according to claim 1, wherein said first and second surfaces are each flat for straightening hair placed therebetween.

7. A hair curling iron and shaping tool according to claim 1, wherein said first and second surfaces each have a wave-like profile for waving hair placed therebetween.

8. A hair curling iron and shaping tool according to claim 1, wherein said first and second surfaces each have a zig-zag profile for crimping hair placed therebetween.

9. A hair curling iron/straightener according to claim 1, further comprising an arrangement for selectively connecting and disconnecting said first and second levers together.

10. A hair curling iron and shaping tool comprising:

a handle;

a first elongated member connected with said handle and having a first surface with a first profile;

a first heating element for heating the first elongated member;

a second elongated member pivotally connected relative to said first elongated member, said second elongated member including:

a second surface for mating with said first surface in order to shape hair placed therebetween in a predetermined manner defined by the first and second surfaces, said second surface having a profile complementary to the profile of said first surface, and a curved surface;

a second heating element for heating the second elongated member;

a curved elongated member pivotally connected relative to said second elongated member for engaging with the curved surface of said second elongated member;

a first lever for actuating said curved elongated member to pivot said curved elongated member away from said second elongated member;

a second lever for actuating said second elongated member to pivot said second elongated member and said curved elongated member together away from said first elongated member; and said second lever is positioned on top of said first lever.

11. A hair curling iron and shaping tool comprising:

a handle;

a first elongated member connected with said handle and having a first surface with a first profile;

a first heating element for heating the first elongated member;

a second elongated member pivotally connected relative to said first elongated member, said second elongated member including:

a second surface for mating with said first surface in order to shape hair placed therebetween in a predetermined manner defined by the first and second surfaces, said second surface having a profile complementary to the profile of said first surface, and a curved surface;

a second heating element for heating the second elongated member;

a curved elongated member pivotally connected relative to said second elongated member for engaging with the curved surface of said second elongated member;

a first lever for actuating said curved elongated member to pivot said curved elongated member away from said second elongated member;

a second lever for actuating said second elongated member to pivot said second elongated member and said curved elongated member together away from said first elongated member; and said first and second levers are pivotally mounted relative to said housing along a common axis.

12. A hair curling iron and shaping tool comprising:

a handle;

a first elongated member connected with said handle and having a first surface with a first profile;

a first heating element for heating the first elongated member;

a second elongated member pivotally connected relative to said first elongated member, said second elongated member including:

a second surface for mating with said first surface in order to shape hair placed therebetween in a predetermined manner defined by the first and second surfaces, said second surface having a profile complementary to the profile of said first surface, and a curved surface;

a second heating element for heating the second elongated member;

a curved elongated member pivotally connected relative to said second elongated member for engaging with the curved surface of said second elongated member;

a first lever for actuating said curved elongated member to pivot said curved elongated member away from said second elongated member;

a second lever for actuating said second elongated member to pivot said second elongated member and said curved elongated member together away from said first elongated member; and the first and second levers each having opposite downwardly extending ears, each ear having an opening therein, and all of the openings of said ears being in axial alignment for receiving a pivot pin arrangement to pivotally fix the first and second levers relative to said housing.

13. A hair curling iron and shaping tool comprising:

a handle;

a first elongated member connected with said handle and having a first surface with a first profile;

a first heating element for heating the first elongated member;

a second elongated member pivotally connected relative to said first elongated member, said second elongated member including:

a second surface for mating with said first surface in order to shape hair placed therebetween in a predetermined manner defined by the first and second surfaces, said second surface having a profile complementary to the profile of said first surface, and a curved surface;

a second heating element for heating the second elongated member;

a curved elongated member pivotally connected relative to said second elongated member for engaging with the curved surface of said second elongated member;

a first lever for actuating said curved elongated member to pivot said curved elongated member away from said second elongated member;

a second lever for actuating said second elongated member to pivot said second elongated member and said curved elongated member together away from said first elongated member; and said second lever includes an opening therein, and said first lever extends through said opening to a position below said second lever.

14. A hair curling iron and shaping tool comprising:

a handle;

a first elongated member connected with said handle and having a first surface with a first profile;

a first heating element for heating the first elongated member;

a second elongated member pivotally connected relative to said first elongated member, said second elongated member including:

a second surface for mating with said first surface in order to shape hair placed therebetween in a predetermined manner defined by the first and second surfaces, said second surface having a profile complementary to the profile of said first surface, and a curved surface;

a second heating element for heating the second elongated member;

a curved elongated member pivotally connected relative to said second elongated member for engaging with the curved surface of said second elongated member;

a first lever for actuating said curved elongated member to pivot said curved elongated member away from said second elongated member;

a second lever for actuating said second elongated member to pivot said second elongated member and said curved elongated member together away from said first elongated member;

said first lever and second lever each have a free end with a head thereon for actuation by a user; and an arrangement for selectively connecting and disconnecting said heads together.

15. A hair curling iron and shaping tool according to claim 14, wherein said arrangement includes a recess in each head, said recesses being in alignment when said first and second levers are in a neutral position, and a button slidable in one of said recesses and adapted to slide partially into the other recess for connecting said heads together.

* * * * *